US010188898B2

(12) United States Patent
James

(10) Patent No.: US 10,188,898 B2
(45) Date of Patent: Jan. 29, 2019

(54) PHYSICAL THERAPY DEVICE AND METHODS FOR USE THEREOF

(71) Applicant: Karen Michelle James, Austin, TX (US)

(72) Inventor: Karen Michelle James, Austin, TX (US)

( * ) Notice: Subject to any disclaimer, the term of this patent is extended or adjusted under 35 U.S.C. 154(b) by 0 days.

(21) Appl. No.: 15/214,646

(22) Filed: Jul. 20, 2016

(65) Prior Publication Data

US 2017/0043204 A1 Feb. 16, 2017

Related U.S. Application Data

(63) Continuation of application No. 14/155,543, filed on Jan. 15, 2014, now abandoned.

(Continued)

(51) Int. Cl.
*A61G 13/12* (2006.01)
*A63B 21/16* (2006.01)

(Continued)

(52) U.S. Cl.
CPC ..... *A63B 21/16* (2013.01); *A63B 21/015* (2013.01); *A63B 21/04* (2013.01); *A63B 21/045* (2013.01); *A63B 21/1609* (2015.10); *A63B 21/1672* (2015.10); *A63B 21/4015* (2015.10); *A63B 21/4035* (2015.10); *A63B 21/4047* (2015.10); *A63B 23/0355* (2013.01); *A63B 23/03541* (2013.01); *A63B 23/03575* (2013.01); *A63B 23/1209* (2013.01); *A63B 71/00* (2013.01); *A63B 21/4034* (2015.10); *A63B 23/0482* (2013.01); *A63B 23/0494* (2013.01); *A63B 23/1245* (2013.01); *A63B 23/1254* (2013.01); *A63B 23/1263* (2013.01); *A63B 23/1272* (2013.01); *A63B 23/1281* (2013.01); *A63B 2071/0018* (2013.01); *A63B 2071/027* (2013.01); *A63B 2208/0233* (2013.01);

(Continued)

(58) Field of Classification Search
CPC ..... A61G 13/12; A61G 13/10; A61G 13/101; A61G 13/104; A61G 13/105
See application file for complete search history.

(56) References Cited

U.S. PATENT DOCUMENTS 5,306,222 A * 4/1994 Wilkinson ..... A41D 13/0015 482/121
2008/0287840 A1* 11/2008 Koscielny ..... A61F 5/01 601/23

* cited by examiner

*Primary Examiner* — Loan H Thanh
*Assistant Examiner* — Rae Fischer
(74) *Attorney, Agent, or Firm* — McBee Moore Woodward & Vanik IP, LLC; Susan McBee; Chester Moore

(57) ABSTRACT

The present application relates to a physical therapy device to strengthen and prevent atrophy in muscles for use while seated in a chair or a wheelchair or while lying in a bed. The physical therapy device includes a back rest; right and left upper arm rests coupled to the back rest by a first connector; and right and left lower arm rests coupled to the right and left upper arm rests, respectively, by a second connector. Each lower arm rest comprises a handle. Each upper arm rest is configured to move towards the back rest at the first connector to fold flush against the back rest. The physical therapy device further comprises an extender coupled to the back rest; right and left upper leg units coupled to the extender by a third connector; and right and left lower leg units coupled to the right and left upper leg units, respectively, by a fourth connector. Each lower leg unit comprises a stirrup.

18 Claims, 11 Drawing Sheets

Related U.S. Application Data

(60) Provisional application No. 61/752,756, filed on Jan. 15, 2013.

(51) Int. Cl.

| | |
|---|---|
| ***A63B 21/015*** | (2006.01) |
| ***A63B 23/035*** | (2006.01) |
| ***A63B 21/04*** | (2006.01) |
| ***A63B 21/045*** | (2006.01) |
| *A63B 23/04* | (2006.01) |
| *A63B 23/12* | (2006.01) |
| *A63B 71/00* | (2006.01) |
| *A63B 71/02* | (2006.01) |
| *A63B 21/00* | (2006.01) |

(52) U.S. Cl.

CPC ..... *A63B 2208/0242* (2013.01); *A63B 2208/0252* (2013.01); *A63B 2209/02* (2013.01); *A63B 2210/50* (2013.01)

PHYSICAL THERAPY DEVICE AND METHODS FOR USE THEREOF

CROSS-REFERENCE TO RELATED APPLICATIONS

This Non-Provisional patent application, filed under 35 U.S.C. § 111(a), is a continuation of U.S. patent application Ser. No. 14/155,543, filed 15 Jan. 2014, which claims the benefit under 35 U.S.C. § 119(e)(1) of U.S. Provisional Patent Application No. 61/752,756, filed under 35 U.S.C. § 111(b) on 15 Jan. 2013, each of which are hereby incorporated by reference in their entirety.

BACKGROUND

1. Field

The present disclosure relates to a physical therapy device for use in a seated or lying position. Further, the present disclosure provides a physical therapy device that may be folded flat for storage or travel.

2. Description of Related Art

It is well known that during extended periods of physical inactivity, muscles atrophy and lose their tone. For example, people who are wheelchair-bound, bedbound (including, for example, pregnant women on bed rest, and persons recovering from accidents, injuries, surgery, or stroke), or confined to zero- or micro-gravity conditions may not be able to engage in sufficiently strenouous physical activity to prevent muscle atrophy and loss of muscle tone.

The solution to this problem is provided by the embodiments characterized in the claims.

BRIEF SUMMARY

The present application relates to a physical therapy device to strengthen and prevent atrophy in muscles for use while, for example, seated in a chair or wheelchair or while lying in a bed. Further, the physical therapy device may be folded flat for storage or travel. It is also lightweight and easy to carry.

An embodiment of the present invention is directed to a physical therapy device comprising a back rest; a right upper arm rest coupled to the back rest by a connector; a left upper arm rest coupled to the back rest by a connector; a right lower arm rest coupled to the right upper arm rest by a connector; and a left lower arm rest coupled to the left upper arm rest by a connector. Each lower arm rest comprises a handle, stirrup, knob, or other attachment or engagement means. Each upper arm rest is configured to move toward the back rest at the first connector to fold flush against the back rest.

The physical therapy device may further comprise an extender portion coupled to the back rest; a right upper leg unit coupled to the extender by a connector; a left upper leg unit coupled to the extender by a connector; a right lower leg unit coupled to the right upper leg unit by a connector; and a left lower leg unit coupled to the left upper leg unit by a connector. Each lower leg unit may comprise a stirrup, bar, or similar means for engaging or attaching to a user's extremity.

In one embodiment is provided a physical therapy device comprising: a back rest; a right upper arm rest removably coupled to the back rest by a first connector; a left upper arm rest removably coupled to the back rest by a second connector; a right lower arm rest removably coupled to the right upper arm rest by a third connector; and a left lower arm rest removably coupled to the left upper arm rest by a fourth connector; wherein each lower arm rest comprises a handle, and wherein the right and left upper arm rests are configured to move toward the back rest at the first and second connectors, respectively, to fold flush against the back rest.

The physical therapy device may further comprise a plurality of clips coupled to the back rest, wherein the clips are configured to fold flush against the back rest and to attach to a back of a chair, a wheelchair, a headboard, or a combination thereof.

The back rest of the physical therapy device may comprise a removable insert. The removable insert may comprise a thin, strong, lightweight, and flexible material.

The physical therapy device may further comprise a head rest coupled to the back rest, wherein the head rest is configured to fold flush against the back rest.

The first and the second connectors may be configured to provide variable resistance between the back rest and the right and left upper arm rests, respectively, and the third and fourth connectors may be configured to provide variable resistance between the right upper arm rest and the right lower arm rest and between the left upper arm rest and the left lower arm rest, respectively.

The may be right lower arm rest is configured to move toward right upper arm rest at the third connector to fold flush against the right upper arm rest, and the left lower arm rest may be configured to move toward left upper arm rest at the fourth connector to fold flush against the left upper arm rest.

The handle may comprise an ergonomical mold.

The physical therapy device may further comprise: an extender removably coupled to the back rest; a right upper leg unit removably coupled to the extender by a fifth connector; a left upper leg unit removably coupled to the extender by a sixth connector; a right lower leg unit removably coupled to the right upper leg unit by a seventh connector, and a left lower leg unit removably coupled to the left upper leg unit by a eighth connector, wherein each lower leg unit comprises a stirrup.

The right upper leg unit may be configured to move toward the back rest at the fifth connector to fold flush against the back rest and the left upper leg unit may be configured to move toward the back rest at the sixth connector to fold flush against the back rest.

The right and left lower leg units may be configured to move toward the right and left upper leg units, respectively, at the seventh and eighth connectors, respectively, to fold flush against the respective upper leg units.

The fifth and sixth connectors may be configured to provide variable resistance between the back rest and the right and left upper leg units, respectively, and the seventh and eighth connectors may be configured to provide variable resistance between the right upper leg unit and the right lower leg unit and between the left upper leg unit and the left lower leg unit, respectively.

The back rest, right and left upper arm rests, and right and left lower arm rests may comprise a synthetic material or a resin covered in light padding.

The right and left upper leg rests and the right and left lower leg rests may comprise a synthetic material or a resin covered in light padding.

The first, second, third, and fourth connectors may be adjustable-tension connectors.

The fifth, sixth, seventh, and eighth connectors may be adjustable-tension connectors.

Each upper arm rest may be configured to move radially with respect to the back rest, the right lower arm rest may be configured to move radially with respect to the right upper arm rest, and the left lower arm rest may be configured to move radially with respect to the left upper arm rest.

Each upper leg unit may be configured to move radially with respect to the back rest, and may be the right lower leg unit is configured to move radially with respect to the right upper leg unit, and the left lower leg unit may be configured to move radially with respect to the left upper leg unit.

BRIEF DESCRIPTION OF THE DRAWINGS

For a further understanding of the nature, objects, and advantages of the present disclosure, reference should be had to the following detailed description, read in conjunction with the following drawings.

DETAILED DESCRIPTION

Before the subject disclosure is further described, it is to be understood that the disclosure is not limited to the particular embodiments of the disclosure described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this disclosure belongs.

Figure 1A:
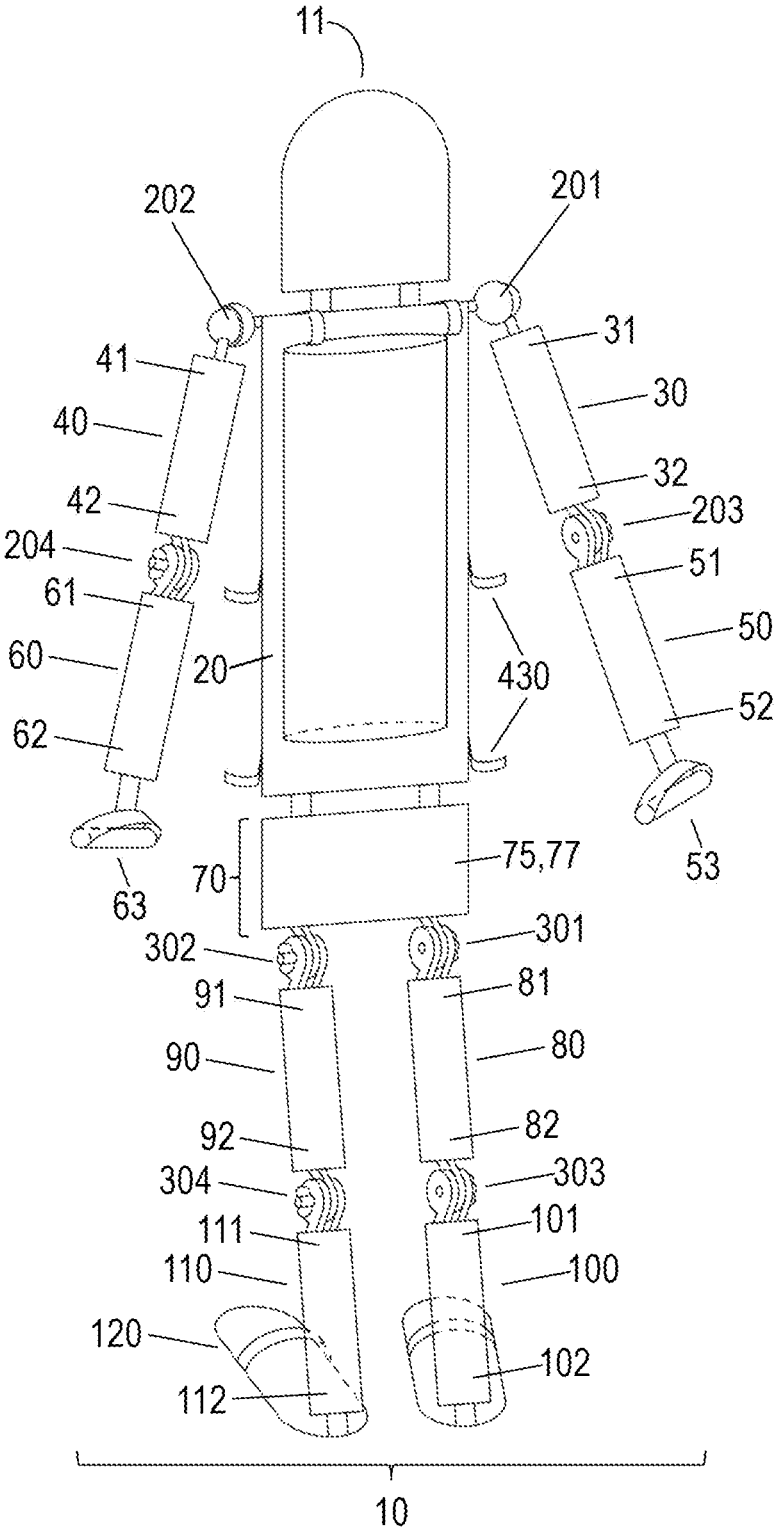
FIGS. 1A & 1B show a physical therapy device of the present invention.
Figure 1B:
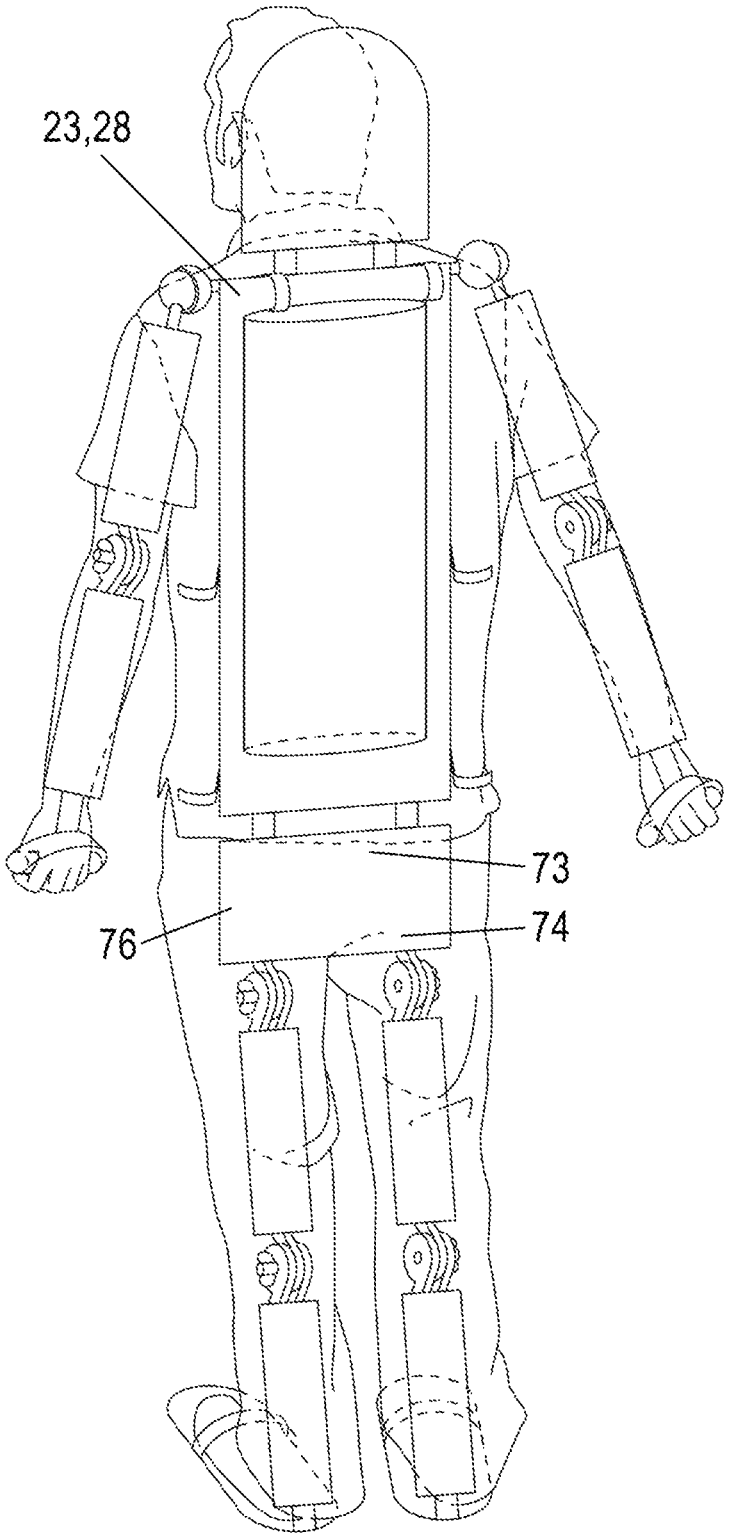

Referring to FIGS. 1A and 1B, there is shown a physical therapy device (10) according to the present invention. The physical therapy device comprises a back rest (20) having front (21) and back (22) surfaces, as well as upper (23), lower (24), right (25), and left (26) sides. The physical therapy device (10) further comprises right (30) and left (40) upper arm rests, each having proximal (31, 41) and distal (32, 42) ends, the proximal end of the right upper arm rest (31) being attached to the right side (25) of the back rest (20), toward the upper side (the upper-right side, 27), and the proximal end of the left upper arm rest (41) being attached to the left side (26) of the back rest (20), toward the upper side (the upper-left side, 28). In other words, both upper arm rests (30, 40) are attached to opposite sides (27, 28) of the back rest (20). The physical therapy device (10) further comprises right (50) and left (60) lower arm rests, each having proximal (51, 61) and distal (52, 62) ends, the proximal end of the right lower arm rest (51) being attached to the distal end of the right upper arm rest (32), and the proximal end of the left lower arm rest (61) being attached to the distal end of the left upper arm rest (42). Each lower arm rest (50, 60) comprises an ergonomically molded handle (53, 63), at the distal end (52, 62), for the user to grasp.

A connector (201) couples the upper-right side (27) of the back rest (20) to the proximal end (31) of the right upper arm rest (30), and a connector (202) couples the upper-left side (28) of the back rest (20) to the proximal end (41) of the left upper arm rest (40). A connector (203) couples the distal end (32) of the right upper arm rest (30) to the proximal end (51) of the right lower arm rest (50), and a connector (204) couples the distal end (42) of the left upper arm rest (40) to the proximal end (61) of the left lower arm rest (60).

The right (30) and left (40) upper arm rests may be folded flush against the right (25) and left (26) sides, respectively, of the back rest (20) via the connectors (201, 202) connecting each upper arm rest to the back rest. The right (50) and left (60) lower arm rests may be folded flush against the right (30) and left (40) upper arm rests, respectively, via the connectors (203, 204) connecting each lower arm rest to each upper arm rest. Thus, the physical therapy device (10) may be folded flat (i.e., for storage or travel).

The physical therapy device (10) according to the present disclosure may further comprise a head rest (11), an optional extender (70), upper leg units (80, 90), and lower leg units (100, 110). The head rest (11) is attached to the upper side (23) of the back rest (20) and an optional extender (70), having front (71) and back (72) surfaces, as well as upper (73), lower (74), right (75), and left (76) sides, is attached via the upper surface (73) to the lower side (24) of the back rest (20). If the optional extender (70) is supplied, then the physical therapy device (10) further comprises right (80) and left (90) upper leg units, each having proximal (81, 91) and distal (82, 92) ends, the proximal end (81) of the right upper leg unit (80) being attached to the lower side (74) of the extender (70), toward the right side (77), and the proximal end (91) of the left upper leg unit (90) being attached to the lower side (74) of the extender (70), toward the left side (78). The physical therapy device (10) further comprises right (100) and left (110) lower leg units, each having proximal (101, 111) and distal (102, 112) ends, the proximal end (101) of the right lower leg unit (100) being attached to the distal end (82) of the right upper leg unit (80), and the proximal end (111) of the left lower leg unit (110) being attached to the distal end (92) of the left upper leg unit (90). The distal end (102, 112) of each lower leg unit (100, 110) comprises an engagement means (120), for example a stirrup or a foot bar, for at least one of the user's lower distal extremities to rest on or otherwise engage at least one lower leg unit (100, 110).

A connector (301) couples the proximal end (81) of the right upper leg unit (80) to the lower side (74) of the extender (70), at the right side (77). A connector (302) couples the proximal end (91) of the left upper leg unit (90) to the lower side (74) of the extender (70), at the left side (78). A connector (303) couples the proximal end (101) of the right lower leg unit (100) to the distal end (82) of the right upper leg unit (80). A connector (304) couples the proximal end (111) of the left lower leg unit (110) to the distal end (92) of the left upper leg unit (90).

The right (80) and left (90) upper leg units may be folded flush against the right (25) and left (26) sides, respectively, of the back rest (20) via the connectors (301, 302) connecting each upper leg unit (80, 90) to the back rest (20). The right (100) and left (110) lower leg units may be folded flush against the right (80) and left (90) upper leg units, respectively, via the connectors (303, 304) connecting each lower leg unit to each upper leg unit. Thus, the physical therapy device (10) may be folded flat (i.e., for storage or travel).

The physical therapy device (10) may slip over the back of a chair with an attachment means (400) such as a sleeve (410) or at least one belt (420). The back surface (22) of the back rest (20) may comprise clips (430), or similar attachment means known in the art, to attach the physical therapy device (10) to the back of a chair, headboard, or wheelchair. The clips (430) may be folded flush against the back rest (22). The physical therapy device (10) may also be stabilized between the user's body and the back of the chair or bed with the user's weight.

The connectors (201-204, 301-304) may provide for flexion and extension (i.e., one degree of freedom) between the back rest (20) and the upper arm rests (30, 40), between the upper arm rests (30, 40) and the lower arm rests (50, 60), between the upper leg units (80, 90) and the extender (70), and between the upper leg units (80, 90) and the lower leg units (100, 110), respectively. The connectors (201-204, 301-304) may provide for flexion and extension, inversion and eversion, or combinations thereof (i.e., two degrees of freedom) between the back rest (20) and the upper arm rests (30, 40), between the upper arm rests (30, 40) and the lower arm rests (50, 60), between the upper leg units (80, 90) and the extender (70), and between the upper leg units (80, 90) and the lower leg units (100, 110), respectively. The connectors (201-204, 301-304) may provide pivotable movement (i.e., three degrees of freedom) between the back rest (20) and the upper arm rests (30, 40), between the upper arm rests (30, 40) and the lower arm rests (50, 60), between the upper leg units (80, 90) and the extender (70), and between the upper leg units (80, 90) and the lower leg units (100, 110), respectively. The device (10) may comprise combinations of connectors (201-204, 301-304) providing one, two, or three degrees of freedom, as desired. For example, the connectors (301, 302) that couple the proximal ends (81, 91) of the upper leg units (80, 90) to the lower side (74) of the extender (70) may provide three degrees of freedom, while the connectors (303, 304) that couple the proximal ends (101, 111) of the lower leg units (100, 110) to the distal ends (82, 92) of the upper leg units (80, 90) may provide one or two degrees of freedom. Similarly, the connectors (201, 202) that couple the upper-right and upper-left sides (27, 28) of back rest (20) to the proximal ends (31, 41) of the upper arm rests (30, 40) may provide three degrees of freedom, while the connectors (203, 204) that couple the distal ends (32, 41) of the upper arm rests (30, 40) to the proximal ends (51, 61) of the lower arm rests (50, 60) may provide one or two degrees of freedom. In this manner, the connectors (201-204) allow the upper arm rests (30, 40) to move with respect to the back rest (20) and the lower arm rests (50, 60) to move with respect to the upper arm rests (30, 40) as shown in FIGS. 2A-2F. The connectors (301-304) also allow the upper leg units (80, 90) to move with respect to the extender (70) and the lower leg units (100, 110) to move with respect to the upper leg units (80, 90) as shown in 3A-3C.

The connectors (201-204, 301-304) may provide resistance to movement between the back rest (20) and the upper arm rests (30, 40), between the upper arm rests (30, 40) and the lower arm rests (50, 60), between the upper leg units (80, 90) and the extender (70), and between the upper leg units (80, 90) and the lower leg units (100, 110). Said resistance may be variable resistance. Adjustable-tension connectors may be used. The resistance may be adjusted in the connectors (201-204, 301-304) for example, by a spring tension system, a ratchet system, twisting screw caps on the connector, tightening and loosening the connector with an allen wrench, and other methods known in the art. The connectors (201-204, 301-304) may also be secured to a revolving plate to allow radial movement of the arm rests (30, 40, 50, 60) and leg units (80, 90, 100, 110) via the connectors (201-204, 301-304).

The materials of construction for the back rest (20), arm rests (30, 40, 50, 60), extender (70), and leg units (80, 90, 100, 110) may be synthetic or other lightweight materials (including, for example: a resin, including those comprising fiberglass and carbon fiber composite; metal, including aluminum, steel, titanium, and alloys thereof; and carbon fiber) optionally covered completely or partially with padding. Thus, the physical therapy device (10) is lightweight and easy to carry. The material may be somewhat flexible for comfort, but rigid enough to provide resistance when connected. The back rest (20) may comprise a removable insert to enhance rigidity when the device (10) is attached to a chair or used in a bed. The insert may be thin, strong, lightweight, and somewhat flexible.

Each of the upper arm rests (30, 40), lower arm rests (50, 60), upper leg units (80, 90), and lower leg units (100, 110) may be fixed or adjustable in length (i.e., the distance between their proximal and distal ends may be static or may be lengthened or shortened at a user's discretion). For example, each of the upper arm rests (30, 40), lower arm rests (50, 60), upper leg units (80, 90), and lower leg units (100, 110) may comprise a telescoping tube, whereby the upper arm rests (30, 40) may be configured to be slidably movable relative to the lower arm rests (50, 60), and vice versa. The upper leg units (80, 90), may be configured to be slidably movable relative to the lower leg units (100, 110), and vice versa. The back rest (20) may be configured to be slidably movable relative to the extender unit (70), and vice versa. Those of ordinary skill in the art will readily apprehend how such slidable movement may be achieved from such devices as, for example, crutches and camera tripods. By providing components that are slidably movable relative to one another, the instant device can be adjusted to accommodate individuals of differing heights, arm lengths, leg lengths, etc.

Each of the upper arm rests (30, 40), lower arm rests (50, 60), upper leg units (80, 90), and lower leg units (100, 110) may optionally be omitted or removed from the device (10) at the user's discretion. Each of the upper arm rests (30, 40) and upper leg units (80, 90) may further comprise attachment or engagement means (e.g., one or more stirrup, strap, handle, knob, bar, or combinations thereof) whereby a user may engage said upper arm rests (30, 40) or upper leg units (80, 90). Such a configuration may be desirable, for example, to better engage a user's extremity with the rest or unit bearing such means. Such a configuration may be particularly desirable if the user is an amputee.

Referring to FIGS. 2A-2F and 3A-3C, there are shown arm and leg movements that may be performed with the physical therapy device (10) of the present invention. When used in a seated position, the back rest (20) of the physical therapy device (10) may be positioned between the back of a user and, for example, a chair, a headboard, or any other structure supporting the user's torso in a substantially upright position. When used in a supine position, the back rest (20) of the physical therapy device (10) may be positioned between the back of the user and, for example, the floor, a bed, or a similar substantially planar surface.

Figure 2A:
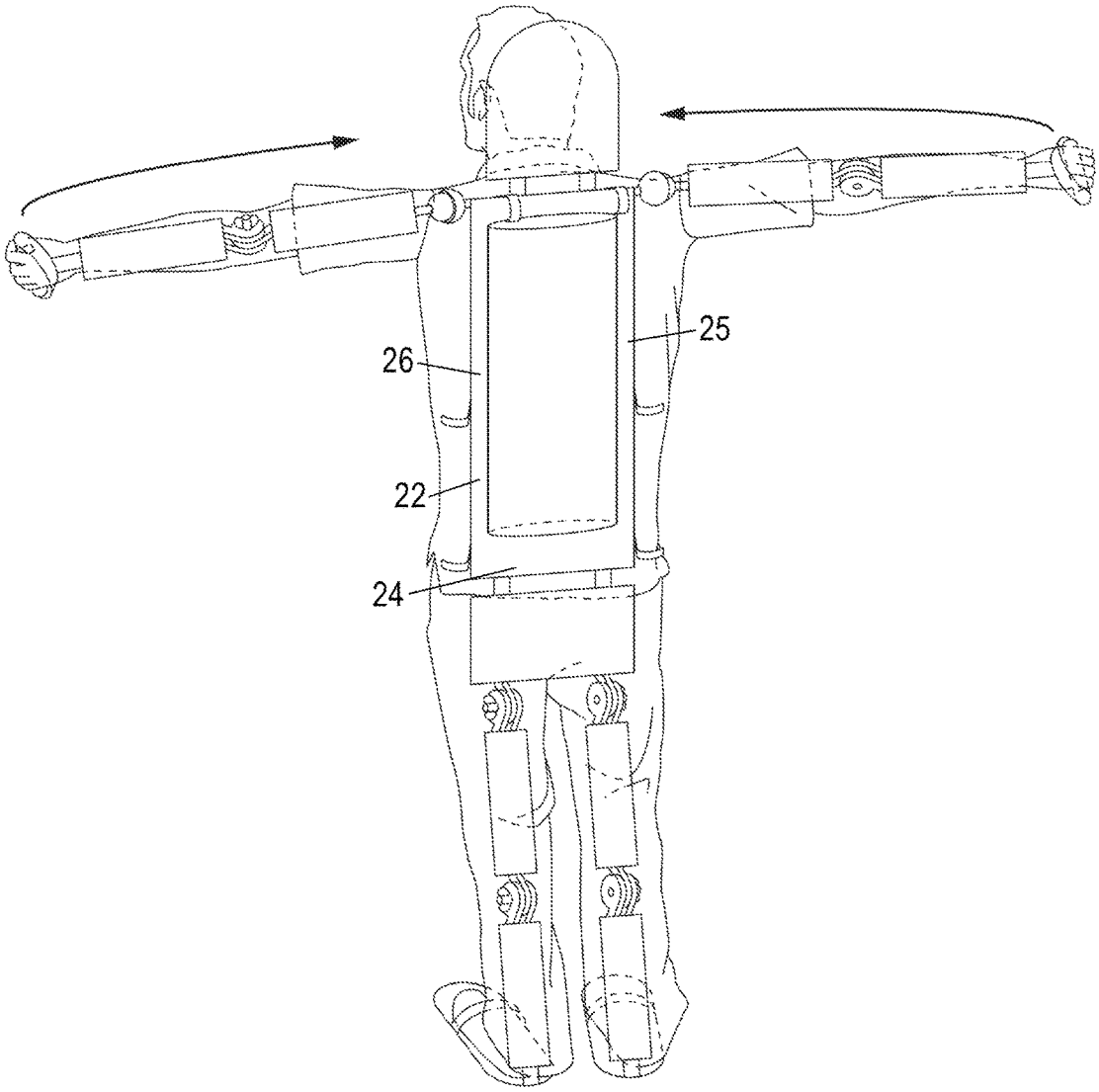
FIGS. 2A-2F show the arm movements that may be performed with the physical therapy device of the present invention.
Figure 2B:
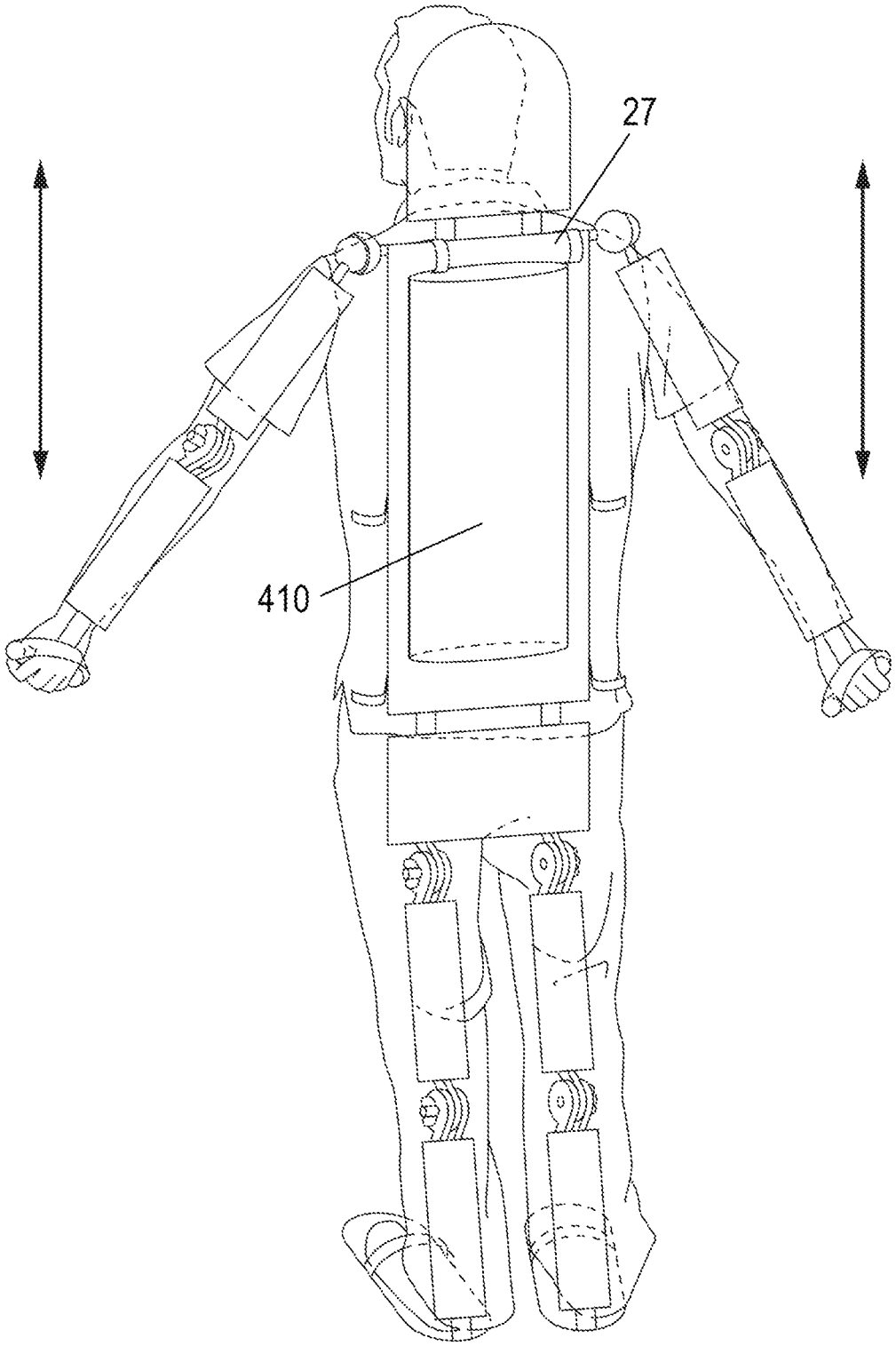
Figure 2C:
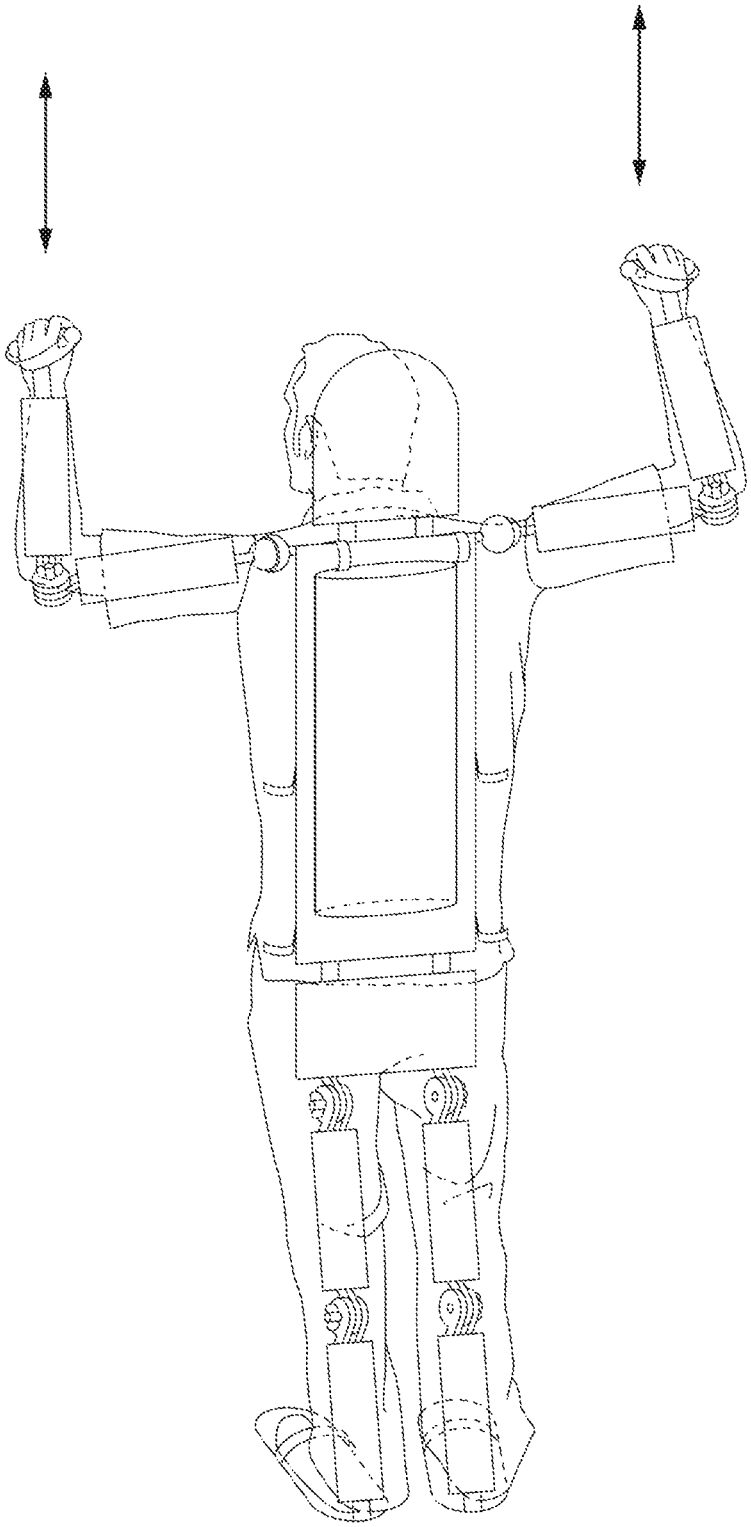
Figure 2D:
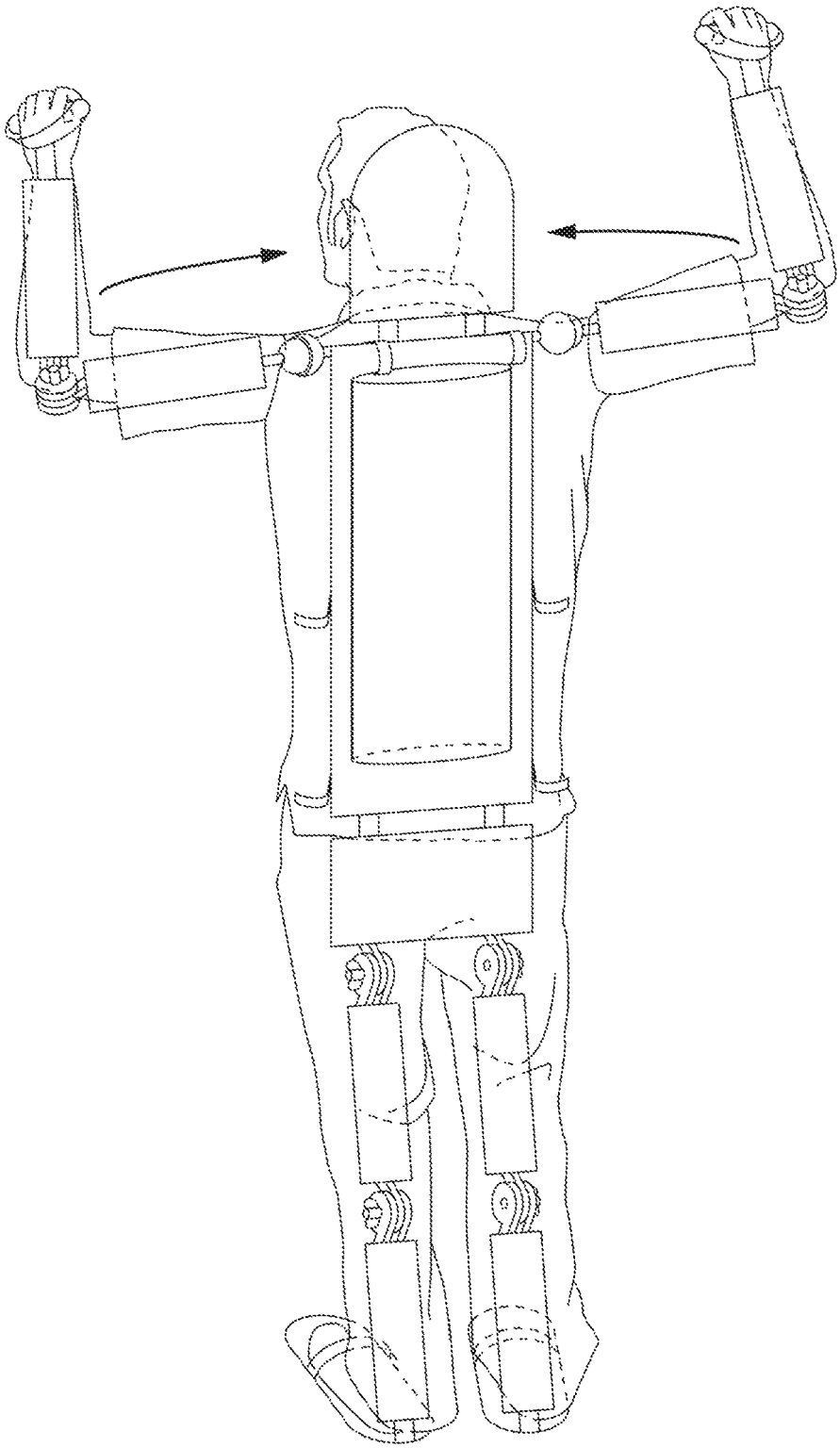
Figure 2E:
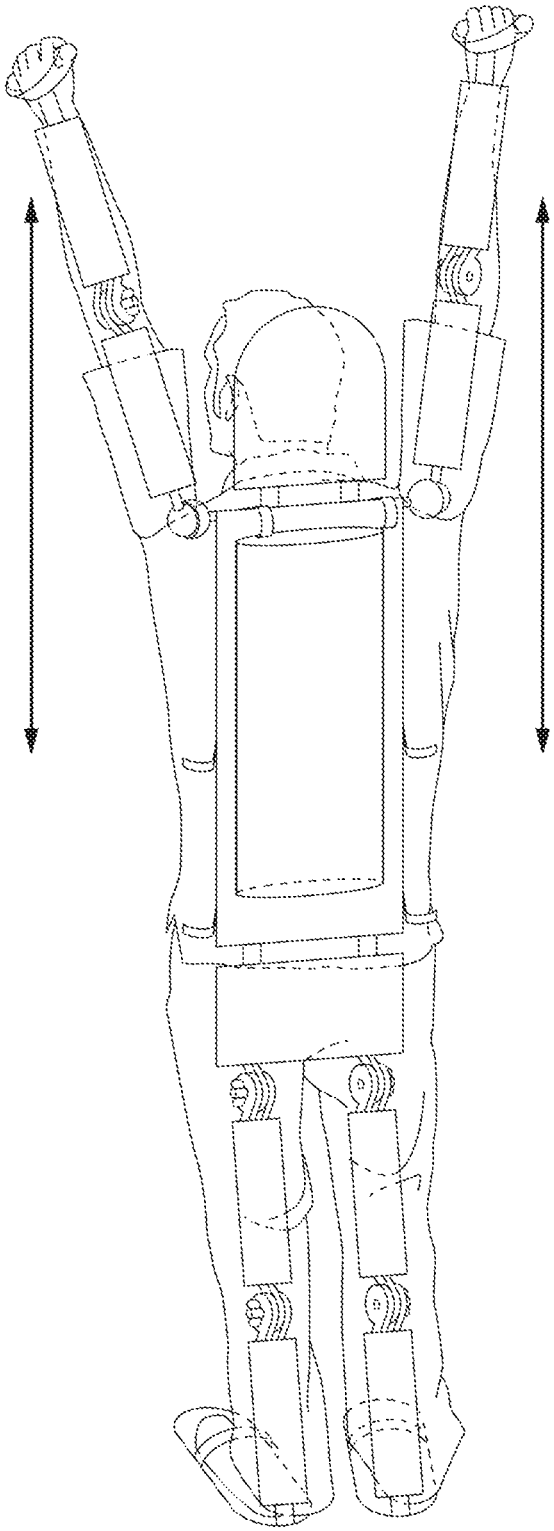
Figure 2F:
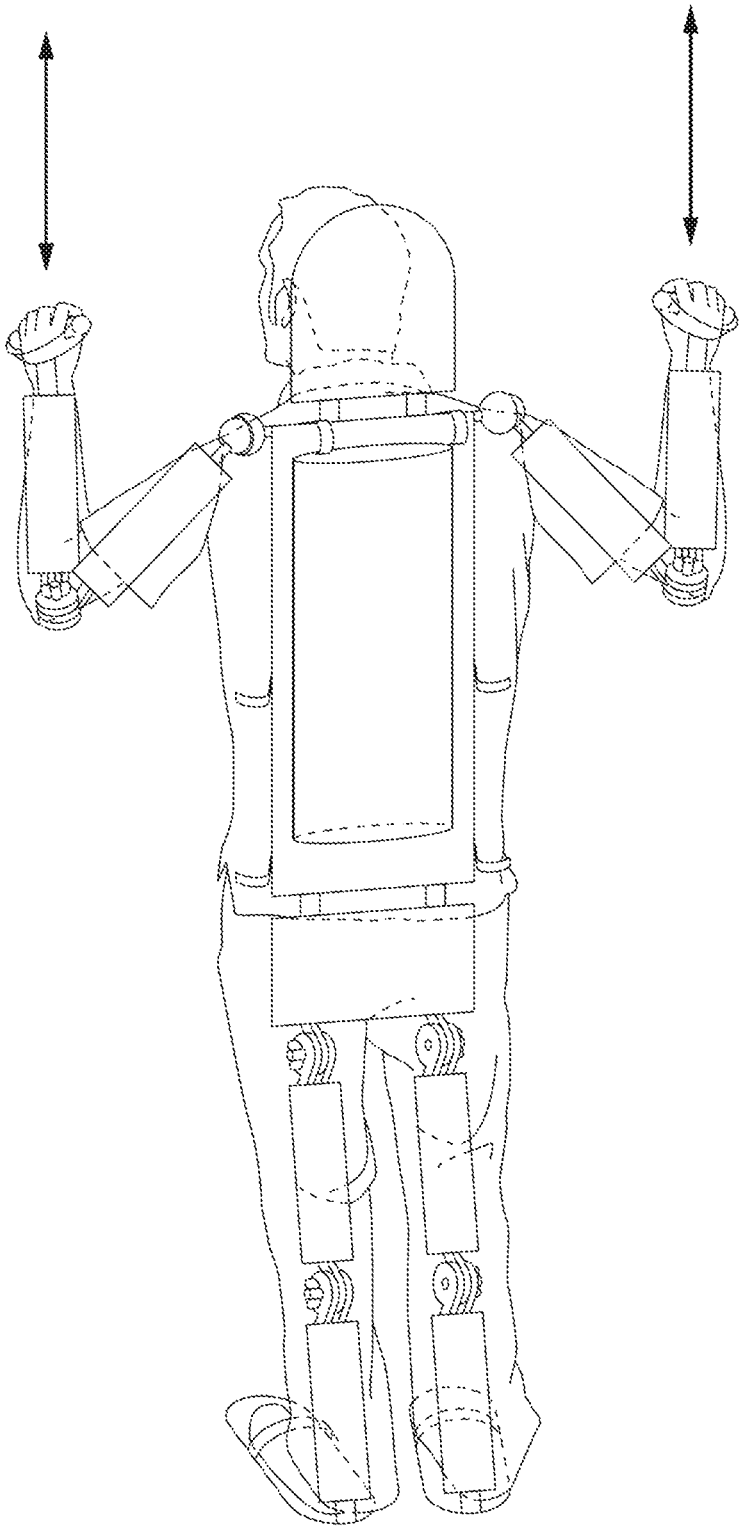

For the movements shown in FIGS. 2A-2F, the user may hold onto the ergonomic handles (53, 63) that follow the shape of a user's arm (e.g., the side or top of said handles). The upper (30, 40) and lower (50, 60) arm rests may rotate, via the connectors (201, 202, respectively) between the back rest (20) and upper arm rests (30, 40) and the connectors (203, 204, respectively) between the upper arm rests (30, 40) and lower arm rests (50, 60), respectively, to accommodate various arm movements. The user may perform various movements such as, for example, adduction (arms straight out to the sides and moving towards the body) and abduction (arms straight at the sides of the body and moving away from the body) as shown in FIG. 2A, arms straight out to the sides and moving up and down along the body axis as shown in FIG. 2B, arms out to the sides with elbows bent and moving up and down for a military press as shown in FIG. 2C, arms out to the sides with elbows bent up and pulling together towards the chest as shown in FIG. 2D, arms straight up overhead and pulling down as shown in FIG. 2E, or arms out to the front with elbows bent and moving up and down for a chest press as shown in FIG. 2F.

Figure 3A:
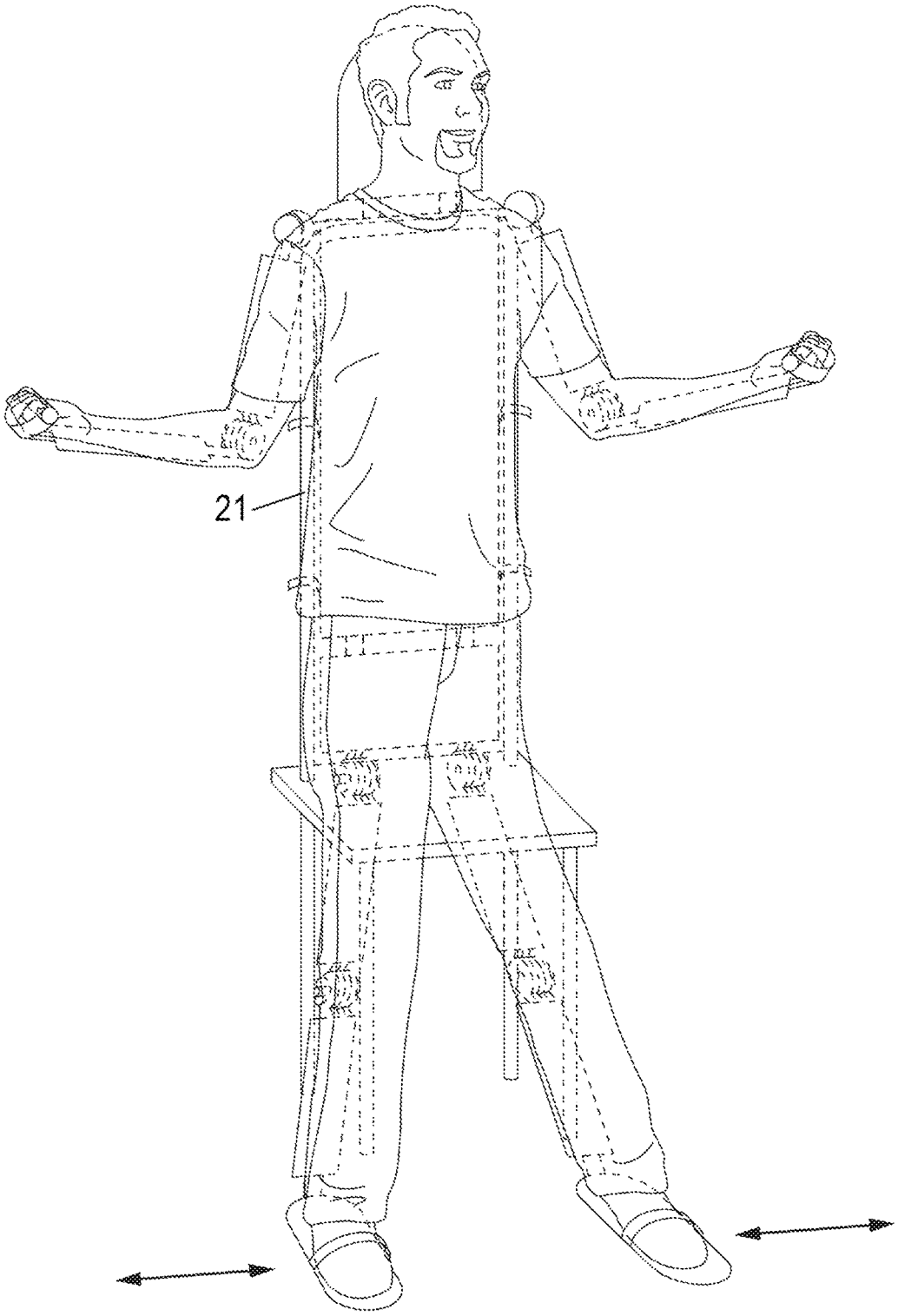
FIGS. 3A-3C show the leg movements that may be performed with the physical therapy device of the present invention.
Figure 3B:
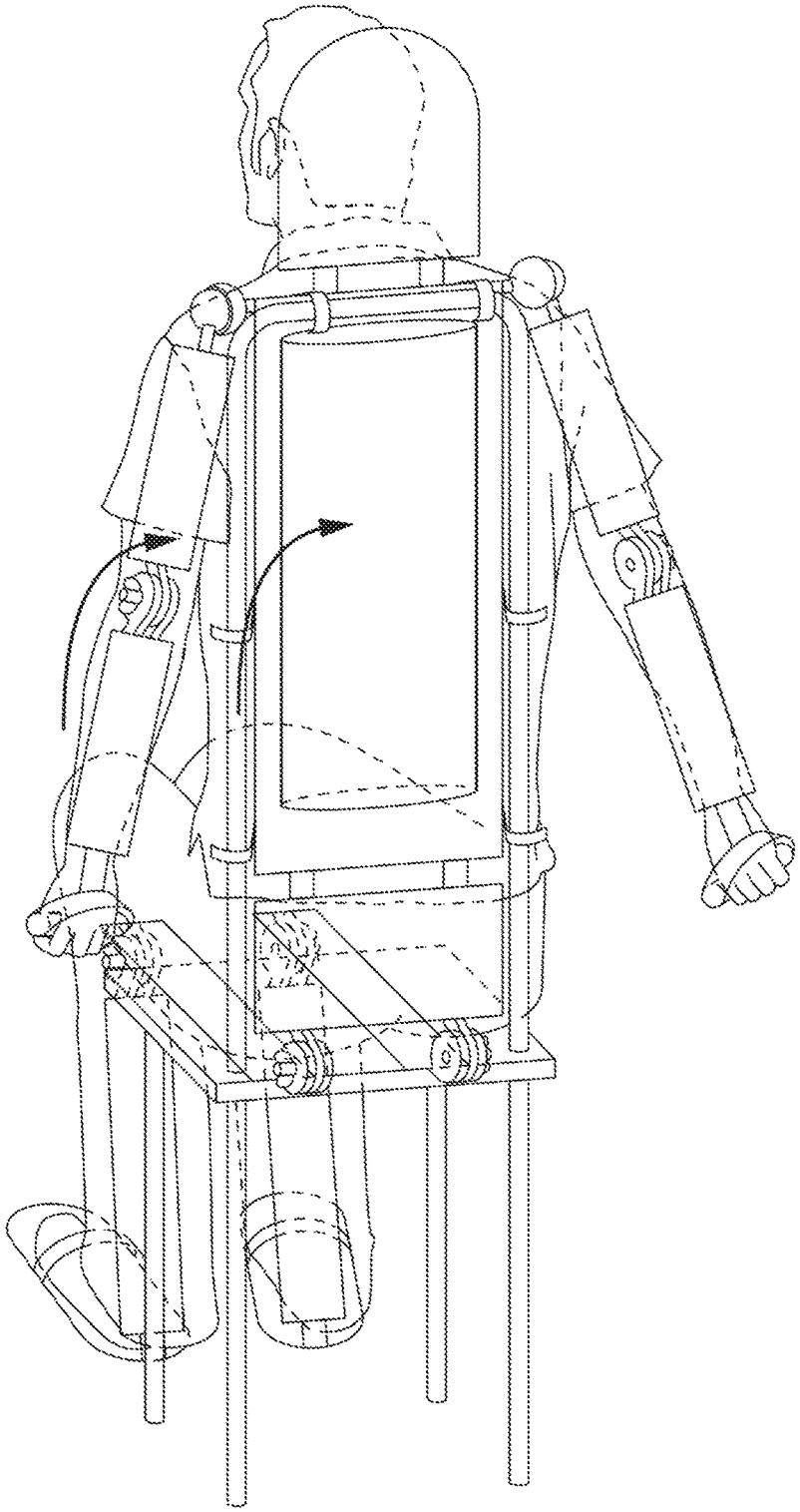
Figure 3C:
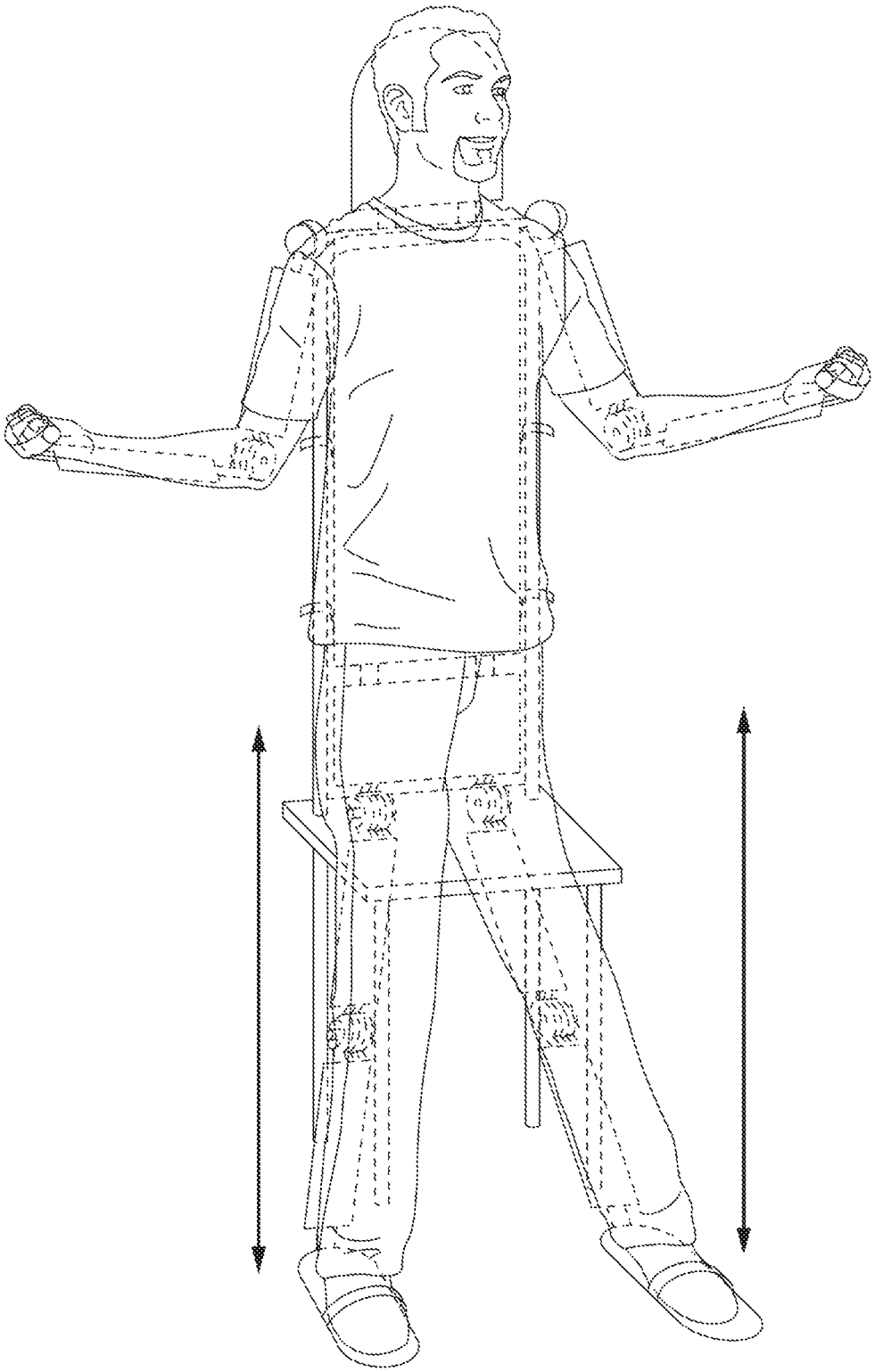

For the movements shown in FIGS. 3A-3F, the user may insert one or more of their lower distal extremities into an appropriate stirrup or foot bar (120). The upper (80, 90) and lower (100, 110) leg units may rotate, via the connectors (301, 302) between the extender (70) and upper leg units (80, 90) and the connectors (303, 304) between the upper leg units (80, 90) and lower leg units (100, 110), respectively, to accommodate various leg movements. The user may perform various movements such as, for example, adduction (legs straight out to the sides and moving towards the body) and abduction (legs straight and moving away from the body) as shown in FIG. 3A, knees bent and pulling the legs up towards the chest as shown in FIG. 3B, or legs straight and lifting up towards the chest as shown in FIG. 3C.

The physical therapy device (10) of the present disclosure may be useful in physical therapy facilities, stroke rehabilitation facilities, hospitals, fitness centers, and spinal, thoracic or cardiac, or orthopedic surgery facilities. The physical therapy device (10) may be used to strengthen and prevent atrophy in wheelchair bound or bed-bound people, pregnant women on bed rest, multiple sclerosis patients, muscular dystrophy patients, and patients recovering from accidents, injuries, surgery, or stroke. The physical therapy device (10) may also be used by athletes for training, by chair-bound office employees for exercise, or by persons in zero- or micro-gravity conditions to slow or prevent muscle atrophy.

| Item | # |
|---|---|
| Physical Therapy Device | 10 |
| Head Rest | 11 |
| Back Rest | 20 |
| Back Rest, front | 21 |
| Back Rest, back | 22 |
| Back Rest, upper side | 23 |
| Back Rest, lower side | 24 |
| Back Rest, right side | 25 |
| Back Rest, left side | 26 |
| Back Rest, upper-right side | 27 |
| Back Rest, upper-left side | 28 |
| Right Upper Arm Rest | 30 |
| Right Upper Arm Rest, proximal end | 31 |
| Right Upper Arm Rest, distal end | 32 |
| Left Upper Arm Rest | 40 |
| Left Upper Arm Rest, proximal end | 41 |
| Left Upper Arm Rest, distal end | 42 |
| Right Lower Arm Rest | 50 |
| Right Lower Arm Rest, proximal end | 51 |
| Right Lower Arm Rest, distal end | 52 |
| Right Lower Arm Rest, handle | 53 |
| Left Lower Arm Rest | 60 |
| Left Lower Arm Rest, proximal end | 61 |
| Left Lower Arm Rest, distal end | 62 |
| Left Lower Arm Rest, handle | 63 |
| Extender | 70 |
| Extender, front | 71 |
| Extender, upper side | 73 |
| Extender, lower side | 74 |
| Extender, right side | 75 |
| Extender, left side | 76 |

-continued

| Item | # |
|---|---|
| Extender, back | 77 |
| Right Upper Leg Unit | 80 |
| Right Upper Leg Unit, proximal end | 81 |
| Right Upper Leg Unit, distal end | 82 |
| Left Upper Leg Unit | 90 |
| Left Upper Leg Unit, proximal end | 91 |
| Left Upper Leg Unit, distal end | 92 |
| Right Lower Leg Unit | 100 |
| Right Lower Leg Unit, proximal end | 101 |
| Right Lower Leg Unit, distal end | 102 |
| Left Lower Leg Unit | 110 |
| Left Lower Leg Unit, proximal end | 111 |
| Left Lower Leg Unit, distal end | 112 |
| Stirrup/Foot Bar | 120 |
| Hinge Joint | 201 |
| Hinge Joint | 202 |
| Hinge Joint | 203 |
| Hinge Joint | 204 |
| Hinge Joint | 301 |
| Hinge Joint | 302 |
| Hinge Joint | 303 |
| Hinge Joint | 304 |
| Attachment Means | 400 |
| Sleeve | 410 |
| Belt | 420 |
| Clips | 430 |

It will be understood that each of the elements described above, or two or more together may also find a useful application in other types of methods differing from the type described above. Without further analysis, the foregoing will so fully reveal the gist of the present disclosure that others can, by applying current knowledge, readily adapt it for various applications without omitting features that, from the standpoint of prior art, fairly constitute essential characteristics of the generic or specific aspects of this disclosure set forth in the appended claims. The foregoing embodiments are presented by way of example only; the scope of the present disclosure is to be limited only by the following claims.

What is claimed is:

1. A physical therapy device comprising:

a back rest;

a right upper arm rest removably coupled to the back rest by a first connector;

a left upper arm rest removably coupled to the back rest by a second connector;

a right lower arm rest removably coupled to the right upper arm rest by a third connector;

a left lower arm rest removably coupled to the left upper arm rest by a fourth connector;

wherein each lower arm rest comprises a handle, the back rest, right and left upper arm rests, and right and left lower arm rests are constructed of a material selected from the group consisting of resin, fiberglass composite, carbon fiber, carbon fiber composite, metal, metal alloys, and combinations thereof, wherein said material is rigid enough to provide resistance when coupled, the third and fourth connectors provide for at least flexion and extension while providing variable resistance to said flexion and extension, and the right and left upper arm rests are configured to move toward the back rest at the first and second connectors, respectively, to fold flush against the back rest.

2. The physical therapy device of claim 1, further comprising a plurality of clips coupled to the back rest, wherein the clips are configured to fold flush against the back rest and to attach to a back of a chair, a wheelchair, a headboard, or a combination thereof.

3. The physical therapy device of claim 1, further comprising a head rest coupled to the back rest, wherein the head rest is constructed of a material selected from the group consisting of resin, fiberglass composite, carbon fiber, carbon fiber composite, metal, metal alloys, and combinations thereof, wherein said material is rigid enough to provide resistance when coupled, and is configured to fold flush against the back rest.

4. The physical therapy device of claim 1, wherein:

the first and the second connectors are configured to provide variable resistance between the back rest and the right and left upper arm rests, respectively, and the third and fourth connectors are configured to provide variable resistance between the right upper arm rest and the right lower arm rest and between the left upper arm rest and the left lower arm rest, respectively.

5. The physical therapy device of claim 1, wherein:

the right lower arm rest is configured to move toward right upper arm rest at the third connector to fold flush against the right upper arm rest, and the left lower arm rest is configured to move toward left upper arm rest at the fourth connector to fold flush against the left upper arm rest.

6. The physical therapy device of claim 1, wherein the handle is an ergonomically molded handle.

7. The physical therapy device of claim 1, further comprising:

an extender removably coupled to the back rest;

a right upper leg unit removably coupled to the extender by a fifth connector;

a left upper leg unit removably coupled to the extender by a sixth connector;

a right lower leg unit removably coupled to the right upper leg unit by a seventh connector, a left lower leg unit removably coupled to the left upper leg unit by a eighth connector, wherein each lower leg unit comprises a stirrup, and the extender, right and left upper leg units, and right and left lower leg units are constructed of a material selected from the group consisting of resin, fiberglass composite, carbon fiber, carbon fiber composite, metal, metal alloys, and combinations thereof, wherein said material is rigid enough to provide resistance when coupled.

8. The physical therapy device of claim 7, wherein the right upper leg unit is configured to move toward the back rest at the fifth connector to fold flush against the back rest and the left upper leg unit is configured to move toward the back rest at the sixth connector to fold flush against the back rest.

9. The physical therapy device of claim 7, wherein the right and left lower leg units are configured to move toward the right and left upper leg units, respectively, at the seventh and eighth connectors, respectively, to fold flush against the respective upper leg units.

10. The physical therapy device of claim 7, wherein the first and the second connectors are configured to provide variable resistance between the back rest and the right and left upper arm rests, respectively, the fifth and sixth connectors are configured to provide variable resistance between the back rest and the right and left upper leg units, respectively, and the seventh and eighth connectors are configured to provide variable resistance between the right upper leg unit and the right lower leg unit and between the left upper leg unit and the left lower leg unit, respectively.

11. The physical therapy device of claim 10, wherein the first, second, third, fourth, fifth, sixth, seventh, and eighth connectors provide for flexion and extension, while providing variable resistance to said flexion and extension.

12. The physical therapy device of claim 10, wherein the first, second, third, fourth, fifth, sixth, seventh, and eighth connectors provide for flexion and extension, for inversion and eversion, or combinations thereof, and further provide variable resistance to said flexion and extension, to said inversion and eversion, or to said combinations thereof.

13. The physical therapy device of claim 10, wherein the first, second, third, fourth, fifth, sixth, seventh, and eighth connectors provide pivotable movement, and further provide variable resistance to said pivotable movement.

14. The physical therapy device of claim 7, wherein the right and left upper leg rests and the right and left lower leg rests comprise a synthetic material or a resin covered in light padding.

15. The physical therapy device of claim 7, wherein the first, second, third, fourth, fifth, sixth, seventh, and eighth connectors are adjustable-tension connectors.

16. The physical therapy device of claim 7, wherein:

each upper arm rest is configured to move radially with respect to the back rest, the right lower arm rest is configured to move radially with respect to the right upper arm rest, the left lower arm rest is configured to move radially with respect to the left upper arm rest, each upper leg unit is configured to move radially with respect to the back rest, the right lower leg unit is configured to move radially with respect to the right upper leg unit, and the left lower leg unit is configured to move radially with respect to the left upper leg unit.

17. The physical therapy device of claim 1, wherein the back rest, the right and left upper arm rests, and the right and left lower arm rests comprise a synthetic material or a resin covered in light padding.

18. The physical therapy device of claim 1, wherein:

each upper arm rest is configured to move radially with respect to the back rest, the right lower arm rest is configured to move radially with respect to the right upper arm rest, and the left lower arm rest is configured to move radially with respect to the left upper arm rest.

* * * * *